US005468271A

United States Patent [19]

Sauer et al.

[11] Patent Number: 5,468,271

[45] Date of Patent: Nov. 21, 1995

[54] DUST FILTER BAG FOR A VACUUM CLEANER

[75] Inventors: Ralf Sauer, Essen; Stefan Kraut-Reinkober, Leverkusen; Ludger Helmes, Velbert; Werner Hoyer, Wuppertal, all of Germany

[73] Assignee: Vorwerk & Co. Interholding GmbH, Wuppertal, Germany

[21] Appl. No.: 144,871

[22] Filed: Oct. 27, 1993

[30] Foreign Application Priority Data

Nov. 3, 1992 [DE] Germany ..... 42 37 035.3

[51] Int. Cl.[6] ..... B01D 46/00

[52] U.S. Cl. ..... 55/357; 55/367; 55/377

[58] Field of Search ..... 55/367, 369, 374, 55/376, 377, 361, 357

[56] References Cited

U.S. PATENT DOCUMENTS

| | | | |
|---|---|---|---|
| 3,417,550 | 12/1968 | Fesco | 55/376 |
| 3,803,815 | 4/1974 | Anderson et al. | 55/377 |
| 3,933,451 | 1/1976 | Johansson | 55/367 |
| 4,861,357 | 8/1989 | Gavin et al. | 55/374 |
| 5,039,324 | 8/1991 | Goldberg | 55/367 |
| 5,045,099 | 9/1991 | Goldberg | 55/367 |
| 5,226,941 | 7/1993 | Uibel et al. | 55/367 |
| 5,230,724 | 7/1993 | Marafante et al. | 55/377 |

FOREIGN PATENT DOCUMENTS

| | | | |
|---|---|---|---|
| 31735 | 4/1961 | Finland | 55/367 |

*Primary Examiner*—C. Scott Bushey
*Attorney, Agent, or Firm*—Martin A. Farber

[57] ABSTRACT

A dust filter bag for a vacuum cleaner, having a holding plate (1) of a cardboard paper material, which holding plate (1) has a sealing-closable opening (9) for a suction pipe of a vacuum cleaner, the opening (9) being adapted to be closed from the outside by a separate closure tab (10) which has an insertion region, and, in order to obtain an improved dust filter bag, the cardboard-paper material is developed in three layers (layers a, b, c) in the region of the opening (9) and in at least two layers in the remaining region of the holding plate (1), a rubber gasket (11) being gripped between two layers, preferably the second and third layers (b, c).

14 Claims, 13 Drawing Sheets

II
30
31
30
3
3
15
14
30
P2
28
10
F
12
30
P1
8
1
11
16
30
28
13
30
D1
D2
II
30
17
9''
6

X
2
30
7
31
6
4
16
15
10
12
11
3
9
4
9'
6
17
7
8
1
18
c
b
a

P2
F
P1
IX
IX
D1
D2
26
30
31
30
3
20
25
24
10
28
21
19
25
23
30
11
1
8
9
9'
30
15
17
9''
6
25
24
21
28
25
23
27
12
30 x
2
7
6
4
3
4
6
7
18
c
b
a
1
8
17
9'
9
11
12,23
10
19
20
31
30

XIX
XIX
30
26
31
30
3
25
24
10
P2
28
25
24
F
12
30
P1
8
1
11
9
9'
30
3
25
24
30
28
25
24
27
D1
D2

X
2
30
7
31
6
26
4
10
27
12
11
3
9
4
6
7
17
8
1
18
c
b
a

DUST FILTER BAG FOR A VACUUM CLEANER

The present invention relates to dust filter bags for a vacuum cleaner which have a holding plate which consists of a cardboard paper material to which a dust bag is attached, for instance by bonding, and which has an opening which can be sealed closed, for a suction pipe of a vacuum cleaner, the opening being adapted to be closed by a separate closure tab which can be moved from an open position, alongside the opening, into a closing position.

The bag-forming filter material is fastened in the vicinity of its edge to the one broad surface of the holding plate, preferably by a sealing adhesive attachment. The body of the bag can be folded together in space-forming manner by swinging the support plate into the plane of the wall-forming layers of the body of the bag. A dust filter bag of this type is known, for instance, from Federal Republic of Germany OS 2 407 478. The separate closure tab in that case consists of a strip which is guided displaceably between two layers of the holding plate and has a hole. When the hole is brought into approximately congruent position with the opening of the holding plate, the socket of the suction tube can be connected there for operation. When the dust filter bag is full, the closure tab is pulled and the part not having the opening of the strip is thereby brought into closing position with respect to the opening. This prevents a sort of breathing motion when the collapsible bag body is grasped. The expelling of particles of dust which is otherwise observed is thereby prevented. In accordance with the variant shown in FIG. 4 of said reference, a strip which holds by pressure-sensitive attachment can also be used as closure tab, which strip can be brought from the zigzag fold in which it is stored into a position which engages over the opening and closes it.

From Federal Republic of Germany Utility Model 90 16 893, it is known to associate with the edge of the opening a sealing foil the diameter of the hole in which is smaller than that of the opening so that the region of the edge of the hole in the foil rests taut in sealing manner against the outer surface of the suction pipe or socket.

The object of the present invention is to provide an improved dust bag filter.

SUMMARY OF THE INVENTION

As the result of the development of the invention, a dust filter bag of improved construction and use is obtained. The region of the opening which is subjected to considerable mechanical stresses by the attachment is extremely stable. For this purpose, one concretely proceeds in the manner that the closure element lies on at least two layers of the solid paper material, and that a rubber gasket is gripped between these two layers in the region of the opening. Together with the decisive improvement of the stability a dependable gripping of a rubber gasket for the connecting socket or the vacuum cleaner is obtained. The holding plate preferably also has—at least in the region of the opening—three layers arranged firmly one above the other. The region of the opening however does not consist merely of the highly stable three-layer laminate; rather the closure element, e.g. a closure tab, is present only within the contours of the holding plate in both the open and the closed positions. With respect to the rubber gasket, a gap between two (lower) layers is also used for the arrangement of the sealing element. The fastening of the sealing element can be included within the laminate attachment, in the manner for example that a layer of adhesive or hot melt covers the rubber gasket, securing its position. There is no additional expense for attachment, as would be necessary, for instance, in the case of a sealing foil which lies on top. Since only a very narrow peripheral fastening zone is sufficient for the rubber gasket, the stabilized composite material continues up to the edge of the support plate. Since this edge generally has a given contour for a corresponding insertion zone of the vacuum cleaner, nose-like projections, etc., even of small dimension, are still very stable in themselves, even in the case of only a two-layer development. The merely partial three-layer nature in the region of the opening, on the other hand, leaves layer material available for further shaping measures. In addition, it has been found advantageous for a region around the edge of the opening in the central layer to be set back with respect to the edges of the opening of the upper and lower layer in order to form a detent opening. In this way, an advantageous condition is created for the securing in place of a closure tab which seals from the outside. Furthermore, it is advantageous that, with a circular development of the opening, the middle layer has a larger diameter than the upper and lower layers, with a concentric arrangement of the diameters. In this connection, the detent opening is supplemented to form a surrounding detent opening so that not even a particularly precise association of the closure tab is necessary. It is furthermore proposed that the holding plate be developed continuously in three layers on its edge. This has the advantage of equally justified support of the holding plate, i.e. completely free of tilting, in the receiver on the appliance side, in which connection, nevertheless, the region located remote from the opening can remain in two layers, thus making layer material available for other purposes, in the manner, for instance, that a closure tab which can be swung over the opening is formed from this remaining material. However, the importance of the multi-layer nature and, in particular the three layer nature of the holding plate is not exhausted hereby since, namely, a development of even independent importance is also provided in that the uppermost layer also develops a holding handle and that the holding handle is developed around or circumscribing the opening. In the position of use of the dust filter bag this holding handle is embedded forming a layer but it can be swung out for transportation or as an aid in removal in order to exercise the corresponding function.

BRIEF DESCRIPTION OF THE DRAWINGS

With the above and other and other advantages in view, the present invention will become more clearly understood in connection with the detailed description of preferred embodiments, when considered with the accompanying drawings of which:

FIG. 21

DETAILED DESCRIPTION OF THE PREFERRED EMBODIMENTS

All four embodiments show a dust filter bag, for instance for a vacuum cleaner, which is closed on the attachment side by a hard part in the form of a holding plate 1. The bag 3 itself extends, glued at its edge, from the rear surface 2 of said holding plate.

The holding plate 1 consists of a cardboard-paper material.

Figure 1:
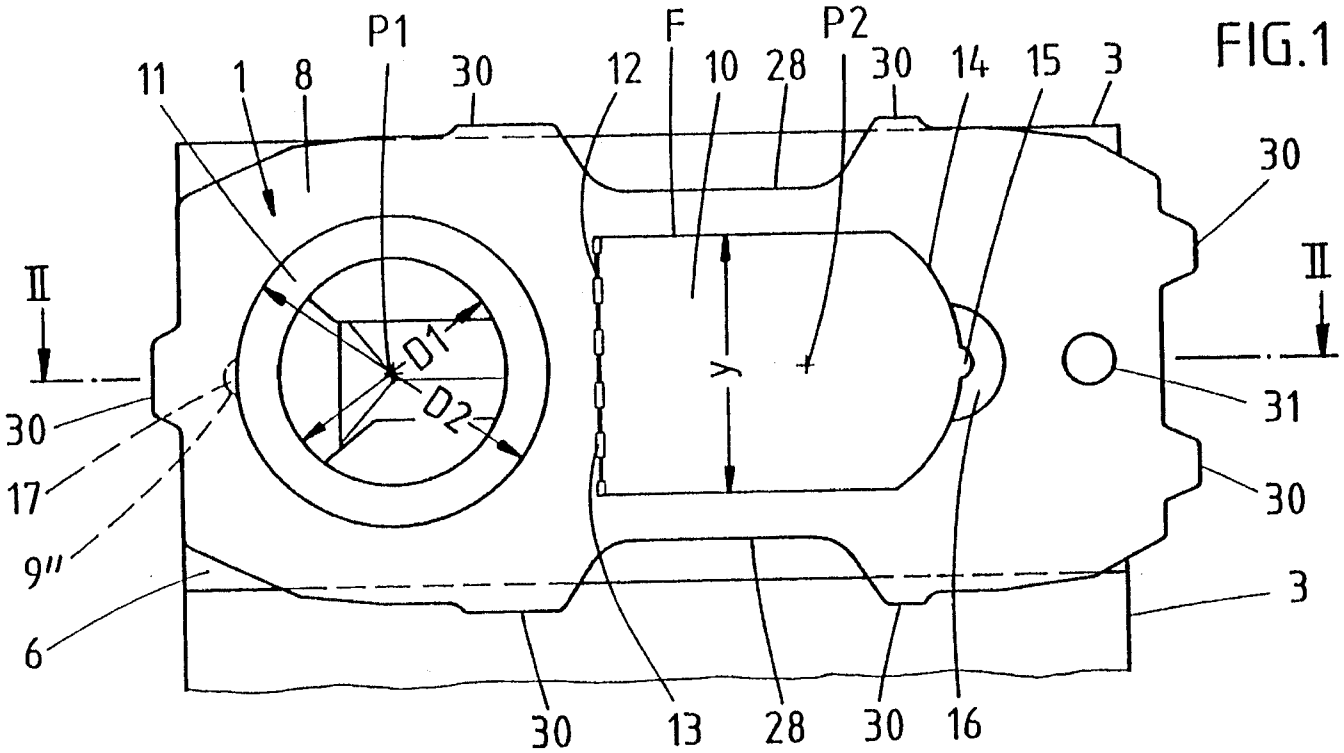
FIG. 1 shows the dust filter bag seen looking at the holding plate with the bag folded together in space-saving manner in accordance with the first embodiment, the bag not being closed.
Figure 10:
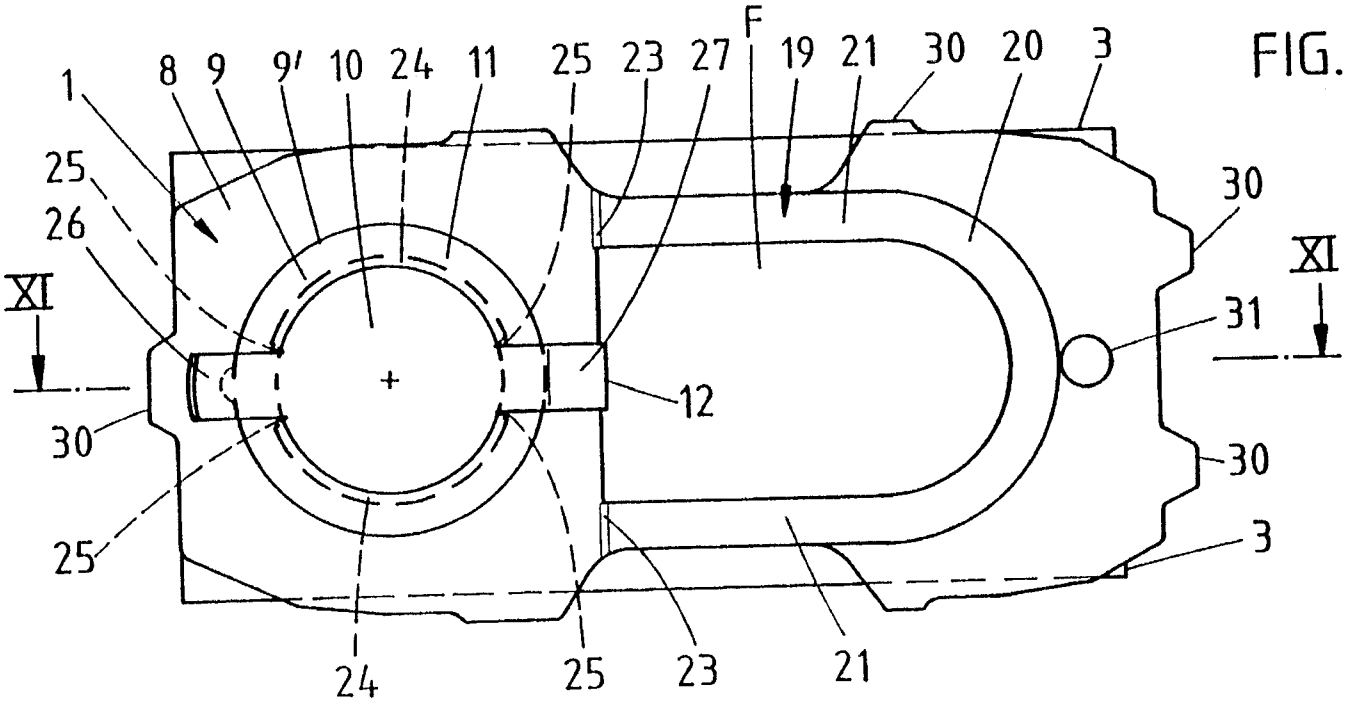
FIG. 10 is a showing such as in FIG. 8, but with the opening closed.

The holding plate 1 has a contour K within which a closure element 10 (explained in greater detail further below) is contained both in the opening position (for instance FIG. 1) and in the closing position (for instance FIG. 10). In the open position, the second layer b also offers full-surface support for the closure element 10.

Figure 2:
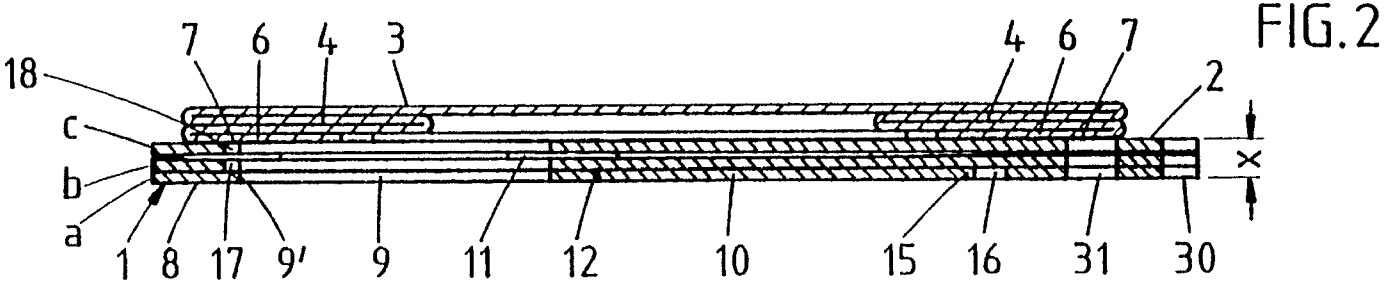
FIG. 2 is a section along the line II—II of FIG. 1.
Figure 3:
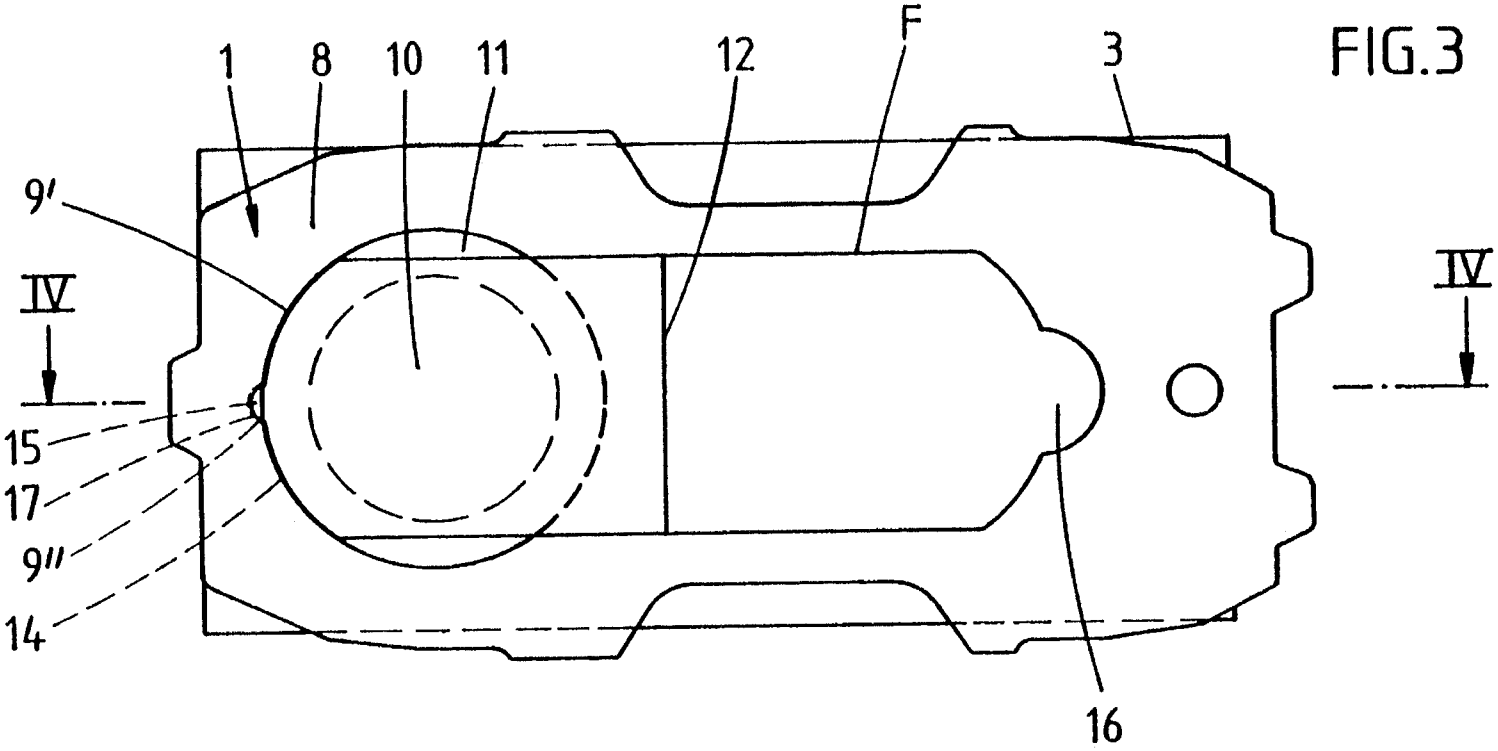
FIG. 3 is a view similar to FIG. 1, but with the opening closed.

The bag 3 can be folded together in space-saving manner. In folded state, it can be applied against the rear surface 2 (see, for instance, FIG. 2). The narrow sides 4 of the bag 3 are for this purpose pulled inward in V-shape. On the side of the holding plate the inner fold branches into a Y-shaped branching which extends directed towards the corner regions of the narrow side of the holding plate 1. On its bottom side, the bag 3 is closed by folding and gluing. The folding bears the reference number 5.

The fixing of the open or mouth-side edge of the bag to the rear surface 2 of the holding plate 1 is effected by the angling-in of the edge 6 there and gluing to said surface 2. The corresponding layer of adhesive is designated 7.

Figure 6:
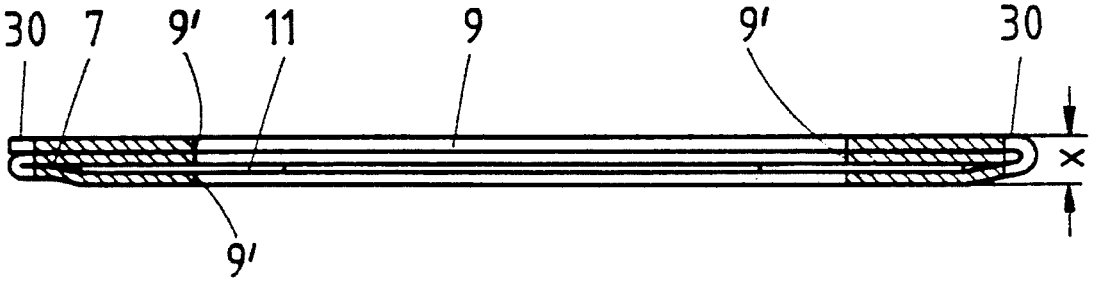
FIG. 6 is a cross section through the three-layer holding plate.
Figure 7:
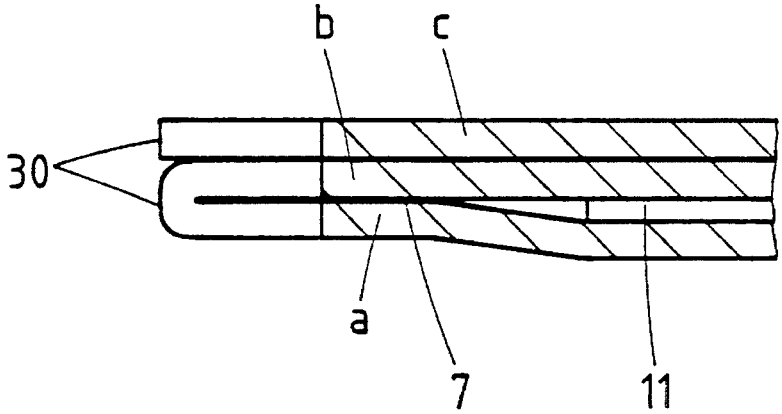
FIG. 7 is an enlarged sectional view of part of the edge region of the holding plate.
Figure 8:
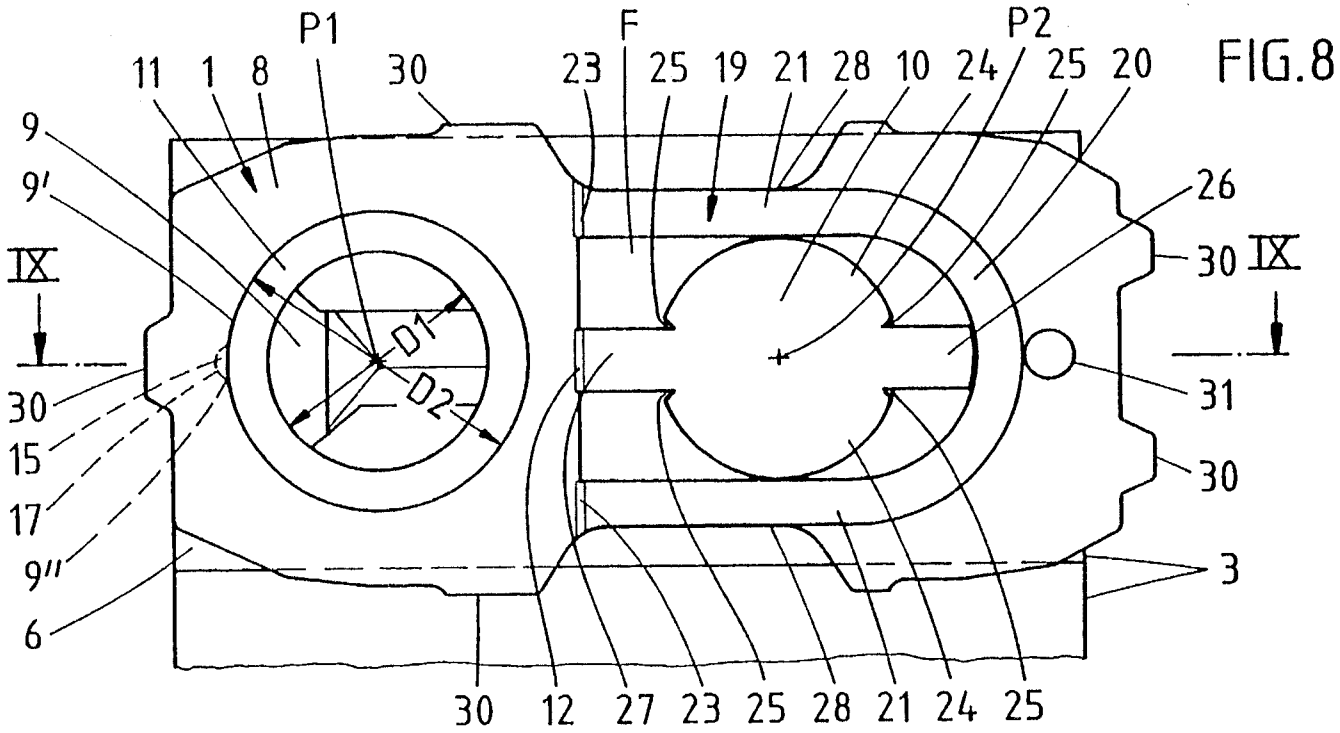
FIG. 8 shows the dust filter bag seen looking at the holding plate with the bag folded together in space-saving manner, in accordance with the second embodiment, the bag being not closed.
Figure 9:
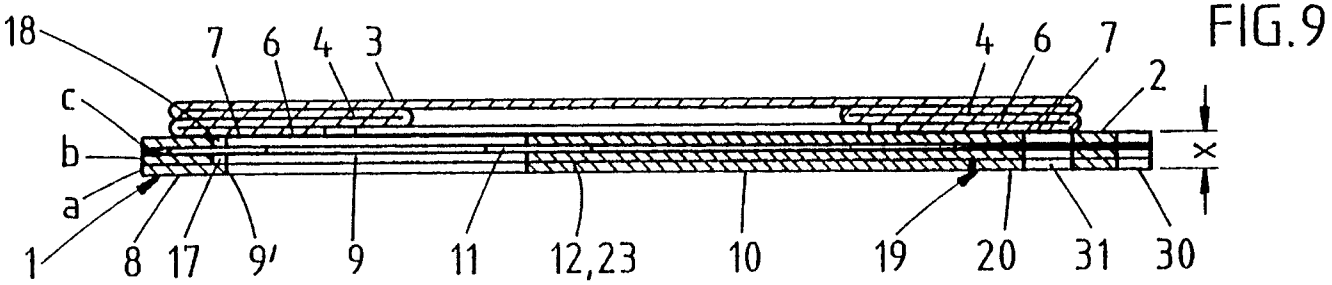
FIG. 9 is a section along the line IX—IX of FIG. 8.

The holding plate 1 which is of basically elongated rectangular shape, is developed continuously or predominantly as three layers. The individual layers which are of identical contour are designated a, b and c. The uppermost layer a, which is furthest from the bag, forms the front surface 8 of the holding plate 1. From there, the attachment is effected of the suction pipe or socket (not shown in detail) of the vacuum cleaner. The individual layers a to c preferably consist of a single folded blank, which is either folded in zigzag shape or formed by the insertion of a free layer between two other end layers, and therefore by swinging two end layer towards each other (see FIG. 6).

The individual layers a to c are pierced to form an opening 9. The opening is circular. Its center point is located in the plane of symmetry of the holding plate 1 which at the same time forms the section line, the two halves of the holding plate being therefore developed as mirror images of each other.

The said opening 9 can be sealed off from the outside by means of a closure tab 10. The latter is an integral part of the uppermost layer a, and therefore formed from the section of material thereof by cutting. By means of such a closure tab 10, the known aspirating of the dust-filled bag 3 upon the reduction of its volume as a result of the grasping thereof can be reduced or even avoided. The free cut is indicated by the letter F.

In all embodiments, the cardboard-paper material consists of three layers, at least in the region of the opening 9. The three-layer laminate stabilizes the region for the attachment of the suction pipe or suction socket of the vacuum cleaner, but, in addition, also has the substantial advantage of receiving in favorable manner a rubber gasket 11 between the seam-forming contact surfaces of two layers. It is preferably arranged between the second and third layers b and c. The gripping thereof can be noted particularly clearly from the sectional showings. The rubber gasket 11 consists of highly elastic annular membrane the inside diameter D1 of which is smaller than the inside diameter of the circular opening D2. Of course, it may also be a plastic foil having corresponding sealing properties.

The radial free depth of the rubber gasket corresponds in width approximately to the depth of gripping between the layers b and c. The depth of gripping has been shown somewhat wider in the drawings.

The inside diameter D1 of the rubber gasket 11 is larger than that of the suction pipe or socket, not shown. The outer wall of the latter extends approximately in the central region of the free-standing length of the rubber gasket 11.

The remaining length or remaining region of the holding plate consists of at least two layers. This region may suitably used with regard to the uppermost layer a to form the closure tab 10. In this way, no separate closing member need be produced and attached. If the corresponding free cut which forms the closure tab does not extend or substantially extend everywhere up to the periphery of said layer, the basic thickness x nevertheless remains in the region of the holding plate 1 which forms the closure tab 10.

This is true in all four embodiments.

Furthermore, all closure tabs 10 swing around a hinge zone which lies transverse to the lengthwise direction of the elongated rectangular holding plate 1. The hinge zone 12 is formed by a fold line. The ease of folding can be increased, for instance, by a perforation 13.

The center point P1 or middle point of the opening 9 is at least as far from the hinge zone 12 as the center point P2 of the closure tab 10. Both lie on the plane or line of symmetry formed by the section lines.

In accordance with the first embodiment, the closure tab 10 has the shape of a long shield with arcuate edge 14 developed on its free end. The radius thereof corresponds to that of the opening 9. The width y of this closure tab 10 corresponds at most to the diameter D2.

Furthermore, a detent nose 15 is located in the zenith of the arcuate edge 14. In front of this detent nose 15, the top layer a leaves a cleared, free-cut region as access depression 16. The later has the size of about the tip of one's finger, so that one can easily grip with one's fingernail below the detent nose 15 in order to swing the closure tab 10 out of its position within the top layer a into the closure position shown in FIG. 4.

This closure position is detented. For this purpose, a detent opening 17 is provided at the place coinciding with 15. This detent opening is formed in the manner that a region of the opening edge of the central layer b is partially set back with respect to the opening edges of the top layer a and bottom layer c. In this way, a free space is formed between the layers a and c in the region of the opening 9, which space serves, in general, for the holding reception of the closure element, i.e., in this case, of the closure tab 10. In detail, for this purpose, detent nose 15 and detent opening 17 are advisedly of semicircular shape. The detent force obtained is so great that even with the holding plate of the dust bag filter facing downward no particles of dirt can drop out of the inside the bag 3. The aspiration is also clearly retarded.

In general, the idea is placed in effect here that the central layer b has a larger recess associated with the opening 9 than the uppermost and lower layers a, c.

Due to the fact that the rubber gasket 11 lies between the second and third layers b, c, an advantageous depth of insertion is obtained into the opening 9 circumscribed by the opening edges. Two layer thicknesses must be passed through. The edges of the opening are in each case designated by 9', the region of the edge of the opening defining the detent opening 17 on the other hand bears the reference numeral 9".

Figure 4:
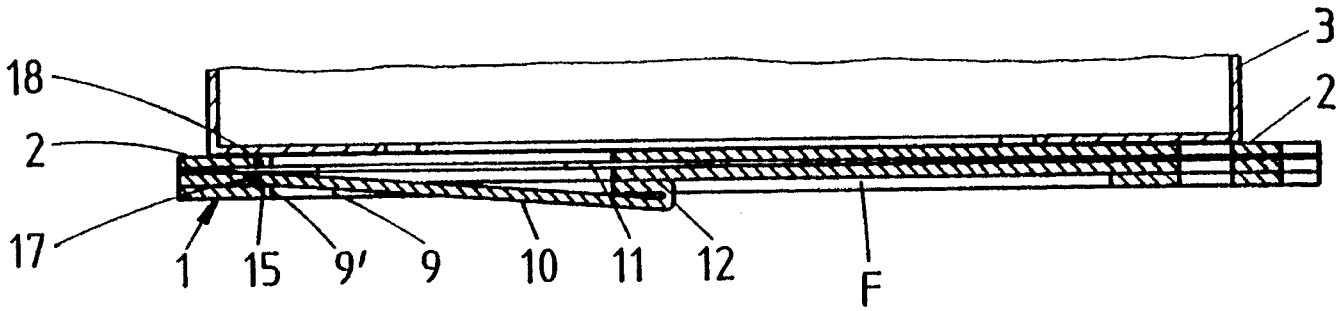
FIG. 4 is a section along the line IV—IV of FIG. 3.
Figure 5:
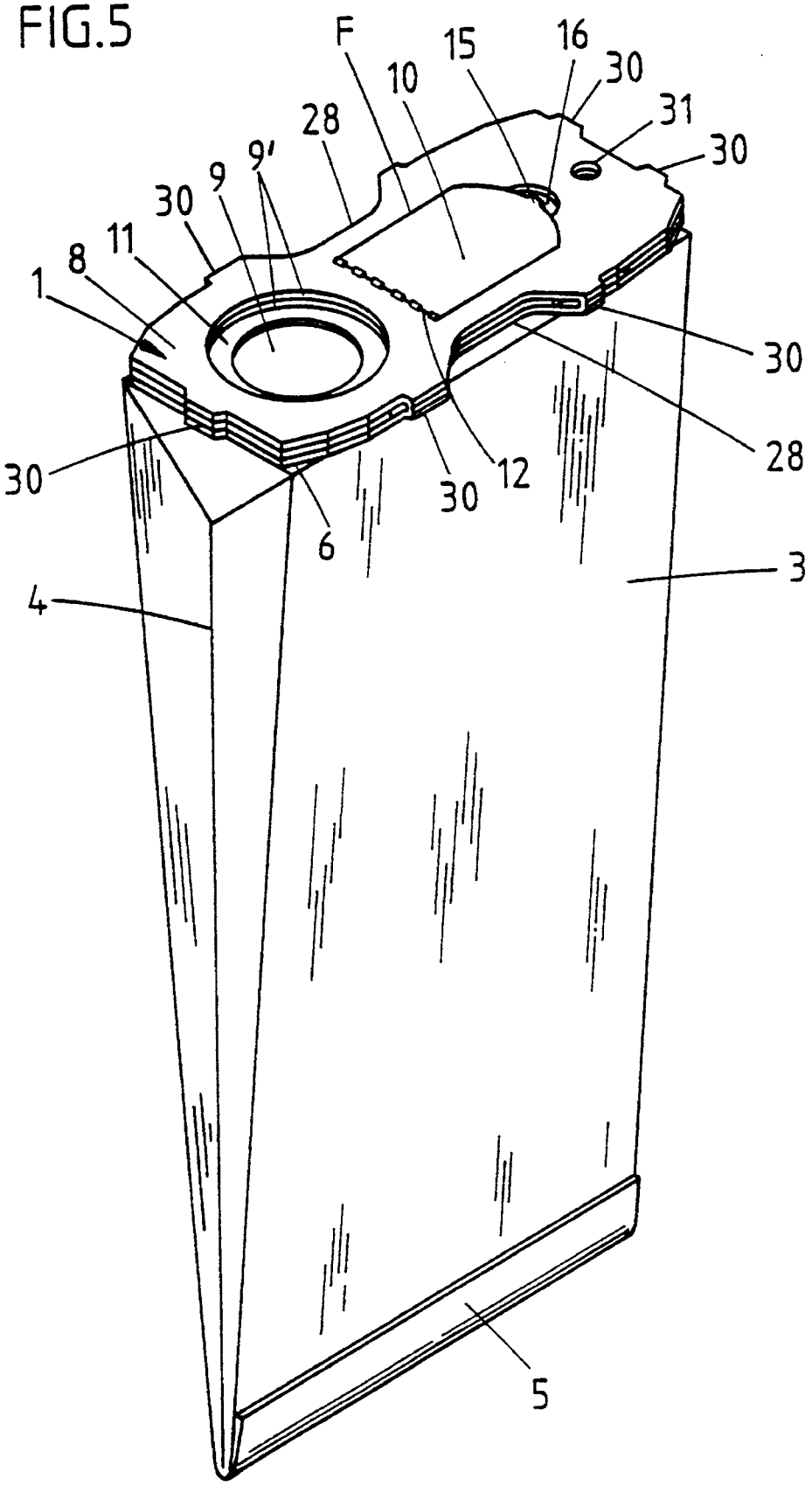
FIG. 5 is a perspective view of the dust filter bag, not closed.

As can be noted from FIG. 4, the third layer c can also have, in coincidence with the detent opening 17, a bulge 18 of corresponding contour. This bulge makes it possible, due to the high elasticity or flexibility of the rubber gasket 11, for the detent nose 15 easily to move away in this direction, but it is moved back by the region of the rubber gasket 14 which extends freely over the bulge 18.

Instead of limiting the detent opening 17 to a relatively small opening region 9" one alternatively proceeds in the manner that, with a circular development of the opening, the central layer b has a somewhat larger diameter than the diameter D2 of the top layer (a) and bottom layer (c), with corresponding concentric arrangement of the diameters. This leads to a detent underengagement of the closure tab 10 of larger area if the tab has a correspondingly widened detent nose 14 or extends down in detent fashion with its entire edge 14.

In the second embodiment, a further development is present to the effect that the other region of the holding plate 1, i.e. the region facing away from the opening 9, is used, in addition to the formation of the closure tab 10, also in order to create a holding handle 19. The latter is of U-shape. Its U-web 20 is of circular shape. The U-arms 21 adjoining it, which extend in parallel in the direction of the opening 9, are each rooted in a hinge zone 23. The latter also extends transverse to the lengthwise direction of the holding plate 1. The hinge zones 23 are aligned with the hinge zone 12 of the closure tab 10. The hinge zones 23 are also formed by fold lines of the blank and can be additionally perforated.

With the holding handle 19 lying flat, it contributes to retaining the basic thickness x. It covers in extent a considerable region in thickness-forming manner so that no tilted insertion of the holding plate need be feared. The surrounding area of the holding handle 19 could therefore definitely be cut away in layers. In the embodiment shown, however, the entire layer a is retained on the periphery.

Figure 12:
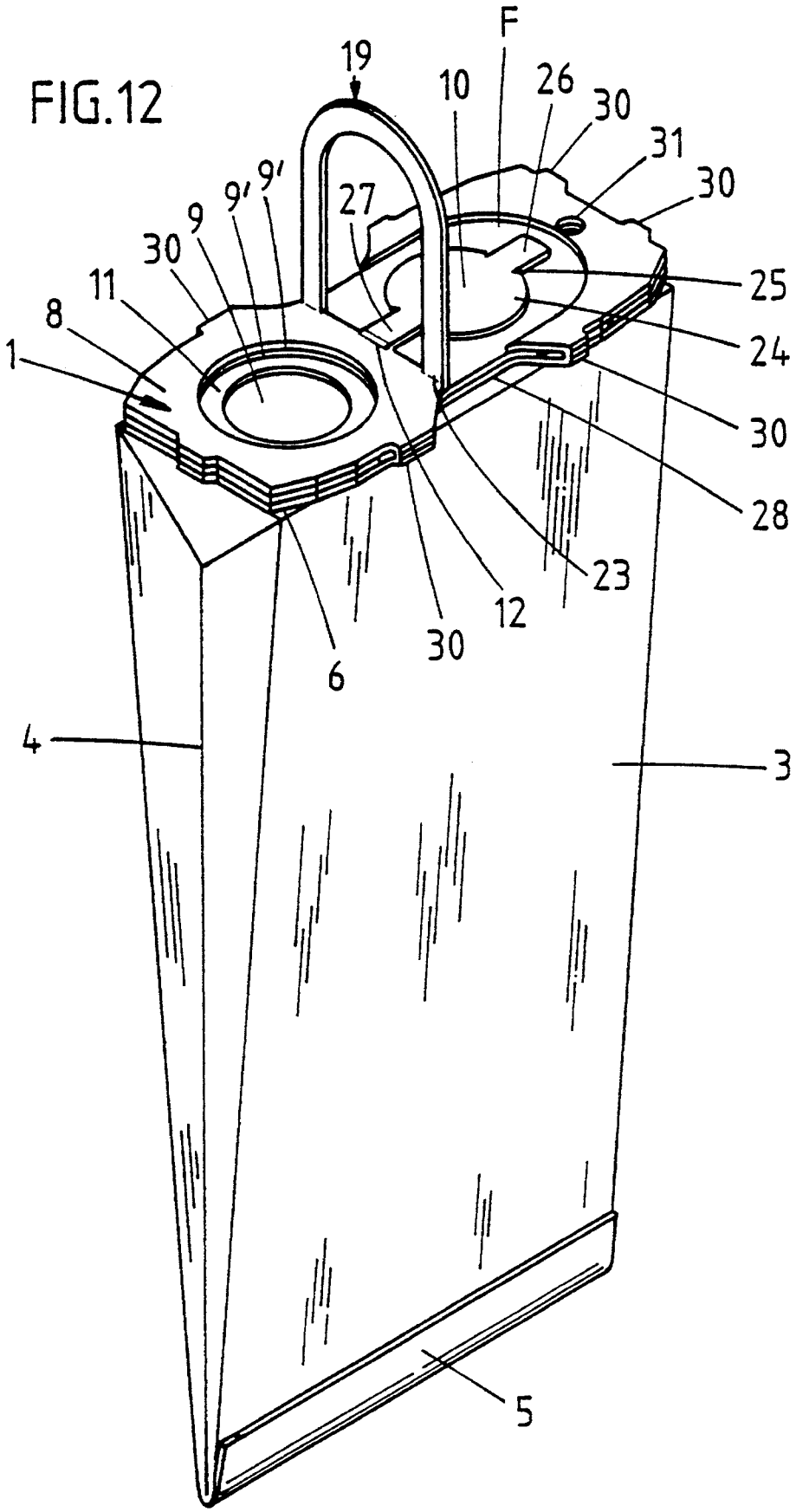
FIG. 12 shows this dust filter bag in perspective, not closed.
Figure 13:
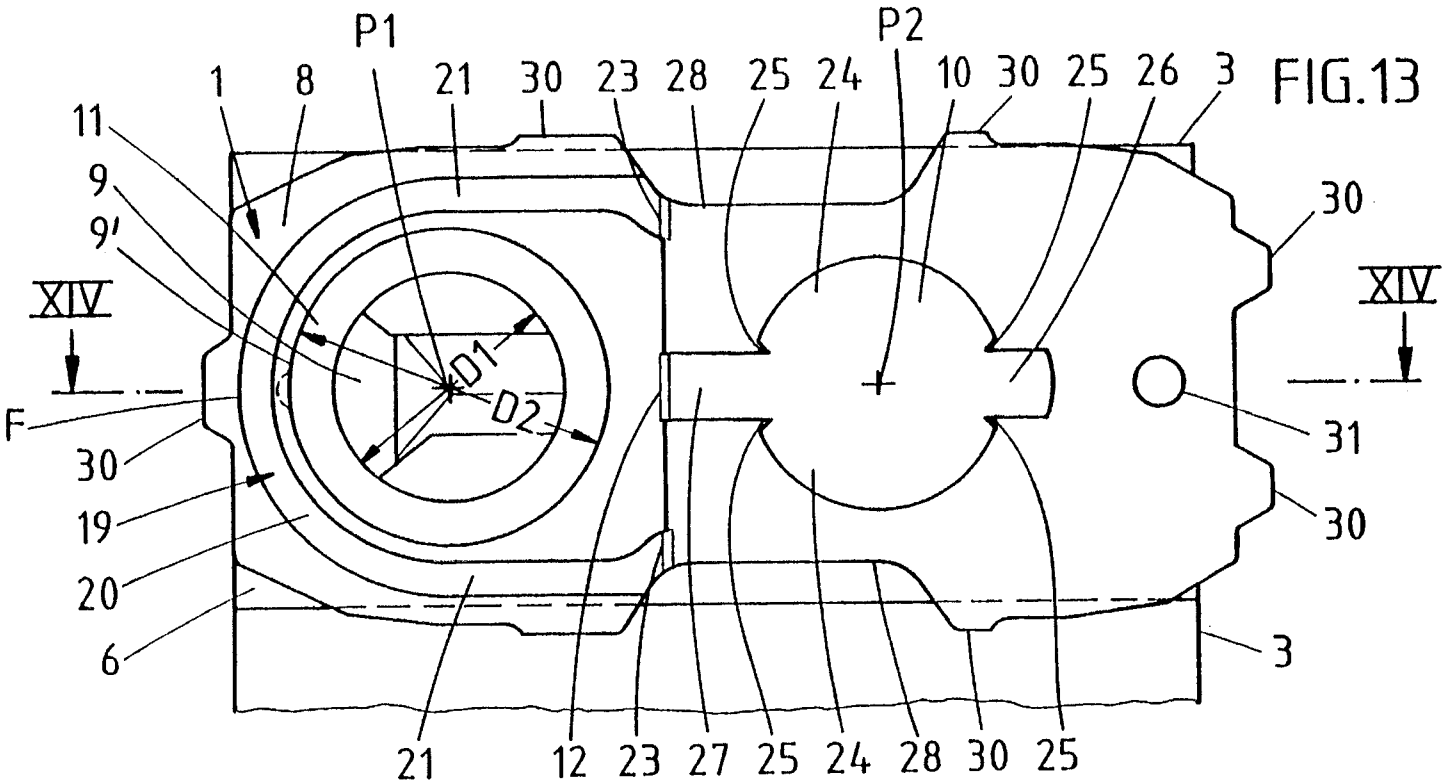
FIG. 13 shows the dust filter bag seen looking at the holding plate with the bag folded together in space-saving manner, in accordance with the third embodiment, the bag being not closed.
Figure 14:
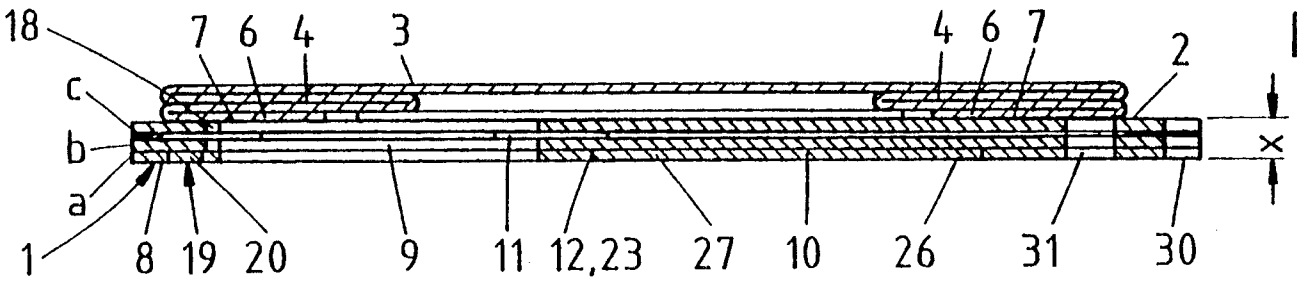
FIG. 14 is a section along the line XIV—XIV of FIG. 13.
Figure 15:
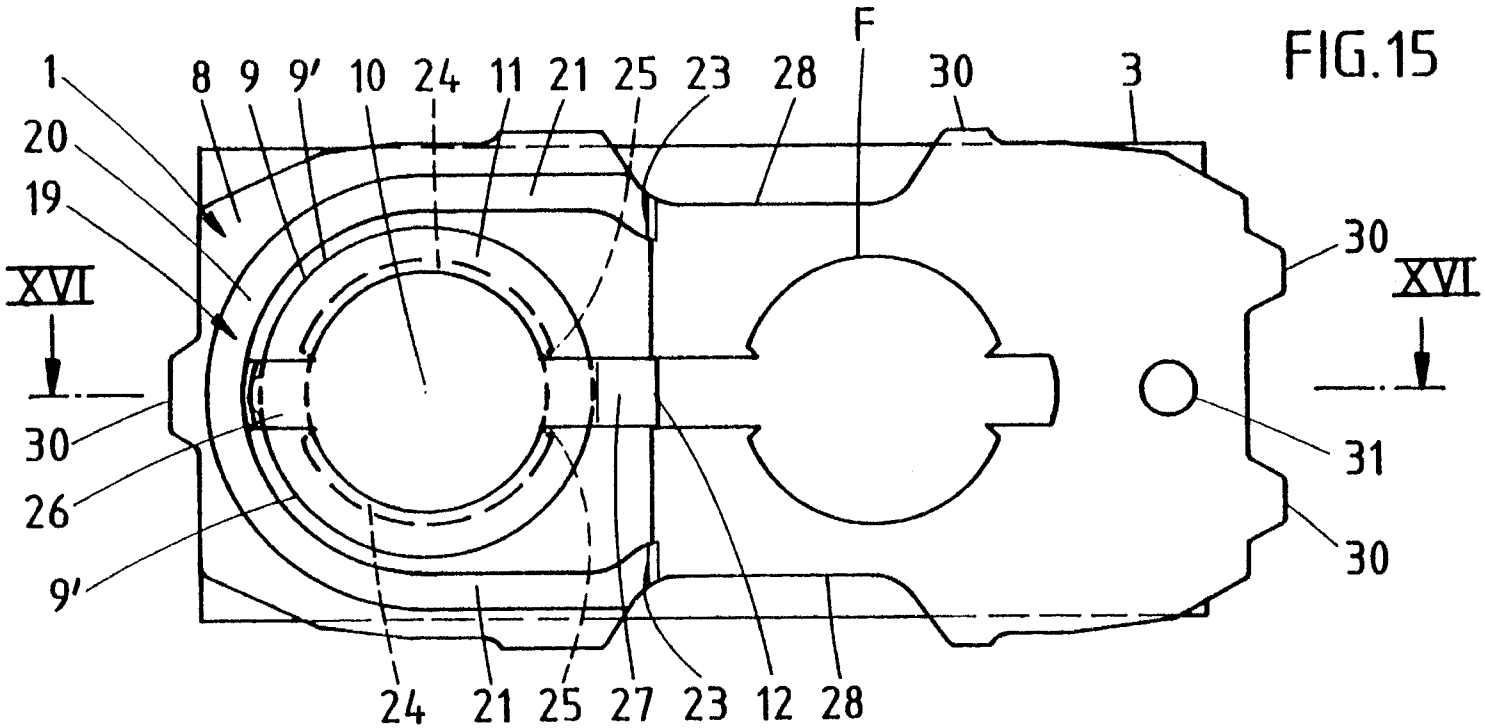
FIG. 15 is a showing similar to FIG. 13, but with the opening closed.
Figure 16:
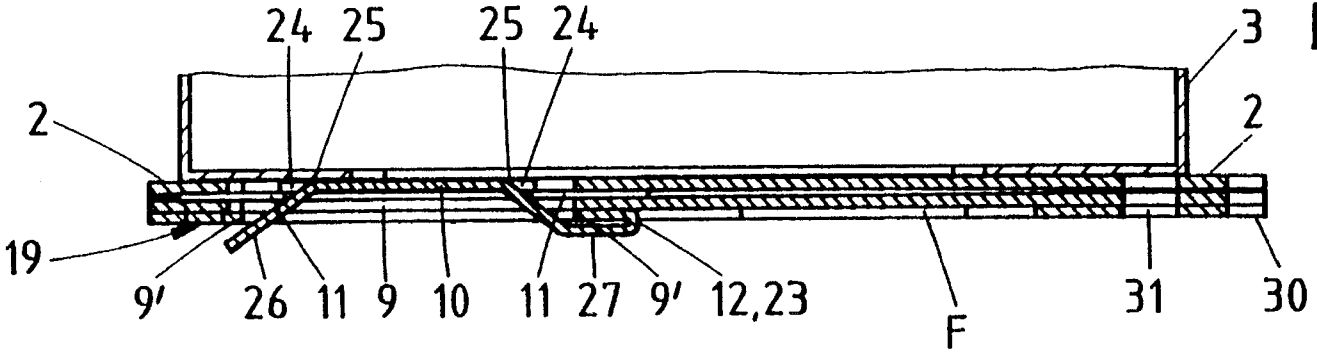
FIG. 16 is a section along the line XVI—XVI of FIG. 15.
Figure 17:
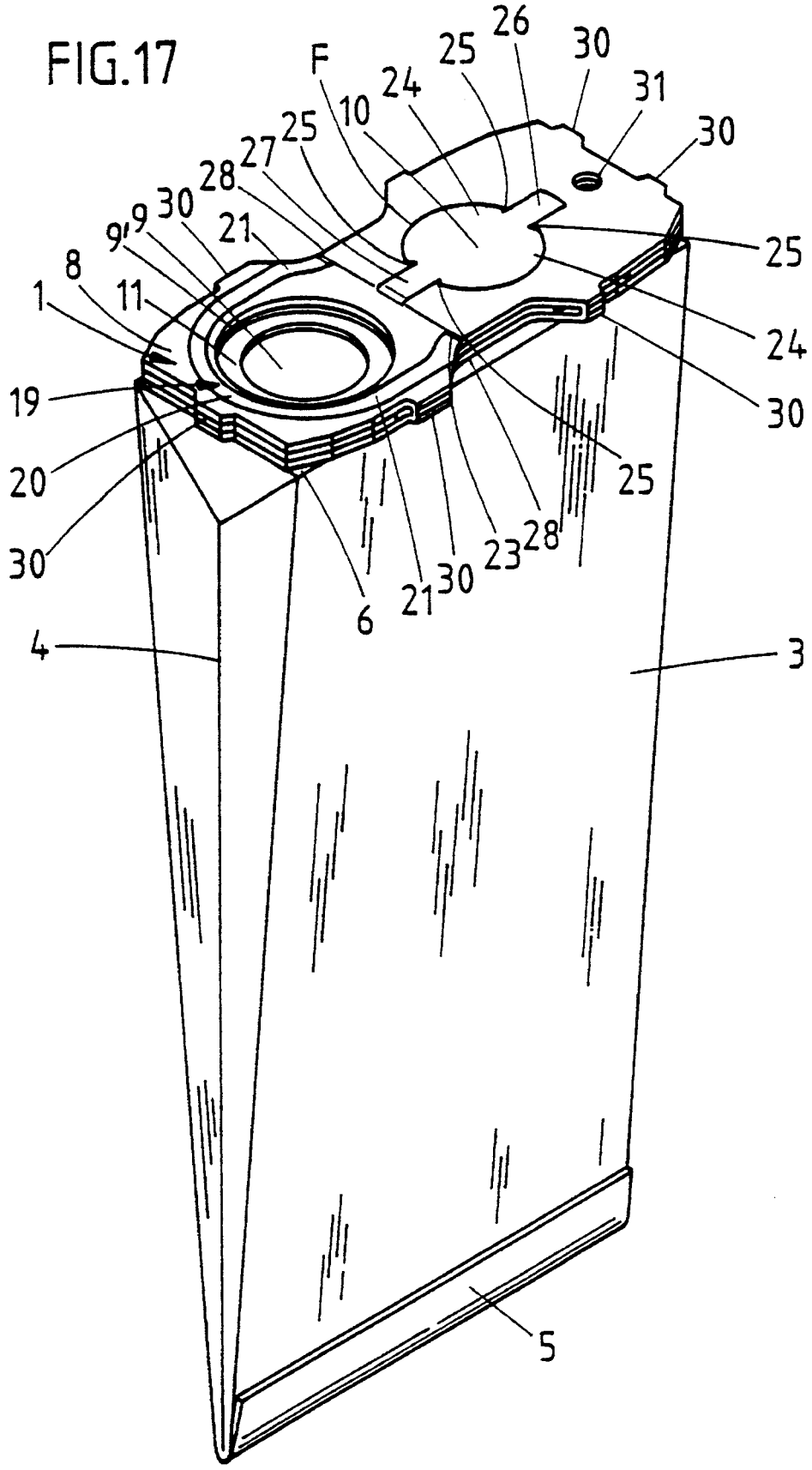
FIG. 17 is a perspective view of the dust filter bag, not closed.
Figure 18:
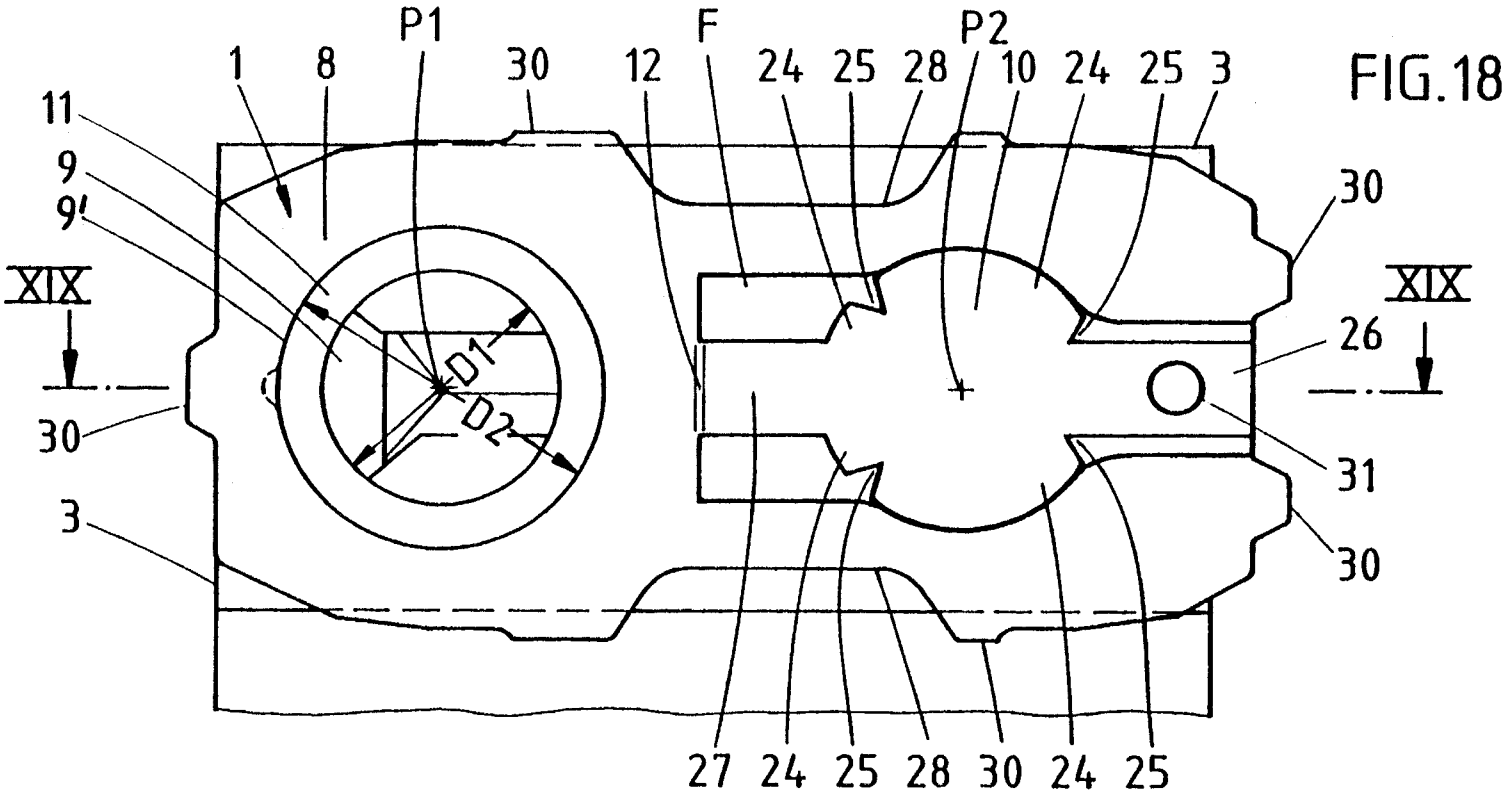
FIG. 18 shows the dust filter bag seen looking at the holding plate, with the bag folded together in space-saving manner, in accordance with the fourth embodiment, not closed.
Figure 19:
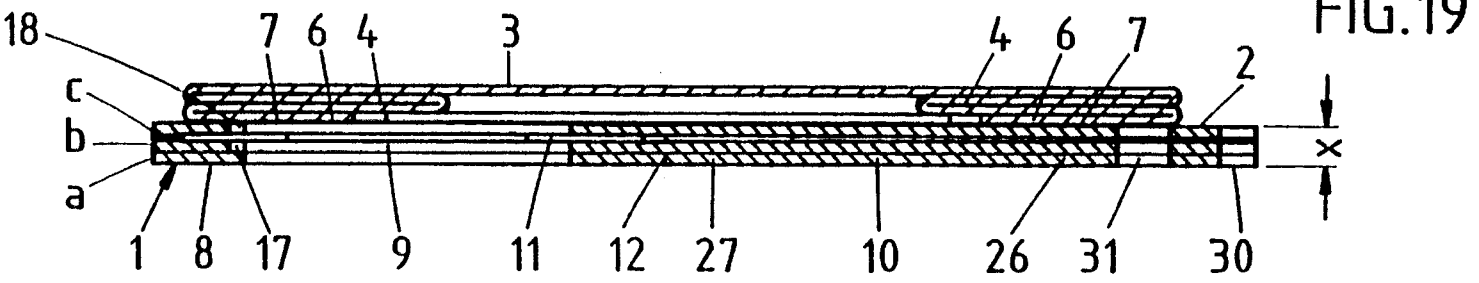
FIG. 19 is a section along the line XIX—XIX of FIG. 18.
Figure 20:
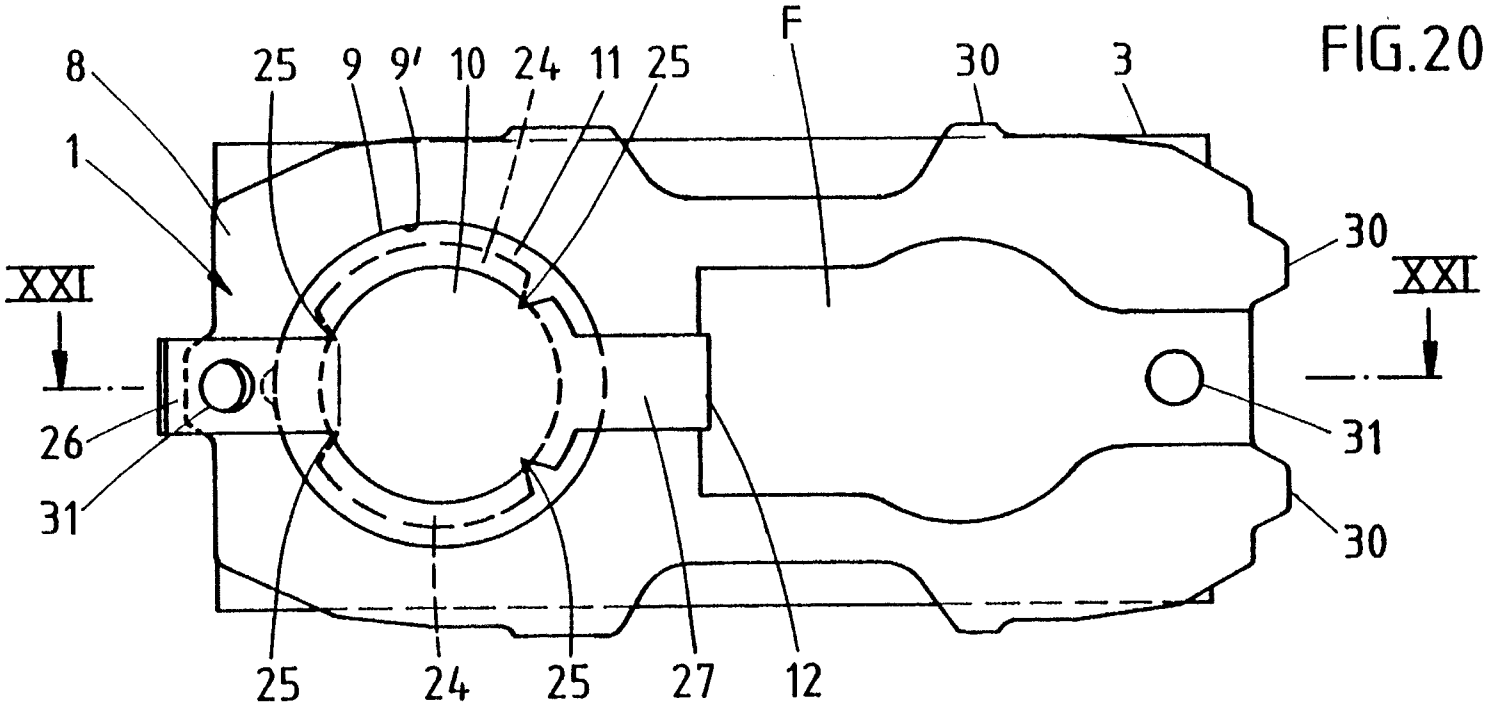
FIG. 20 is a showing such as FIG. 18, but with the opening closed.
Figure 21:
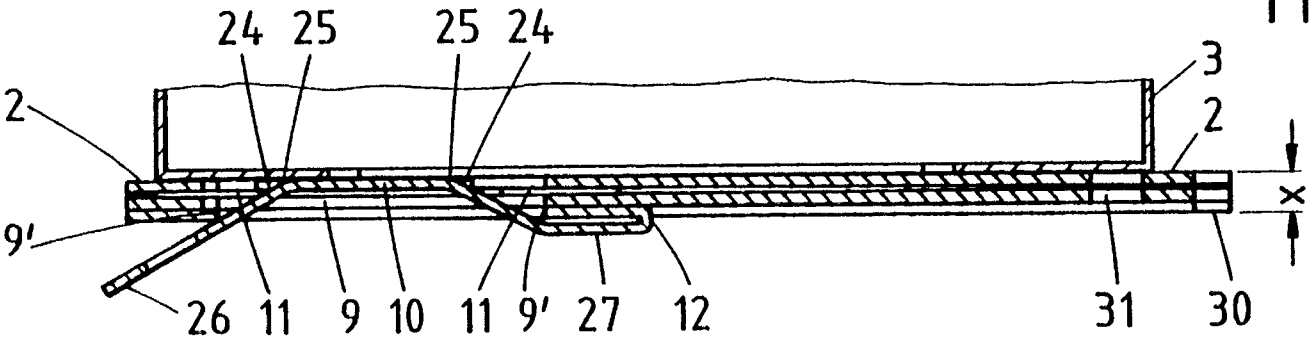
FIG. 21 is a section along the line XXI—XXI of FIG. 20.
Figure 22:
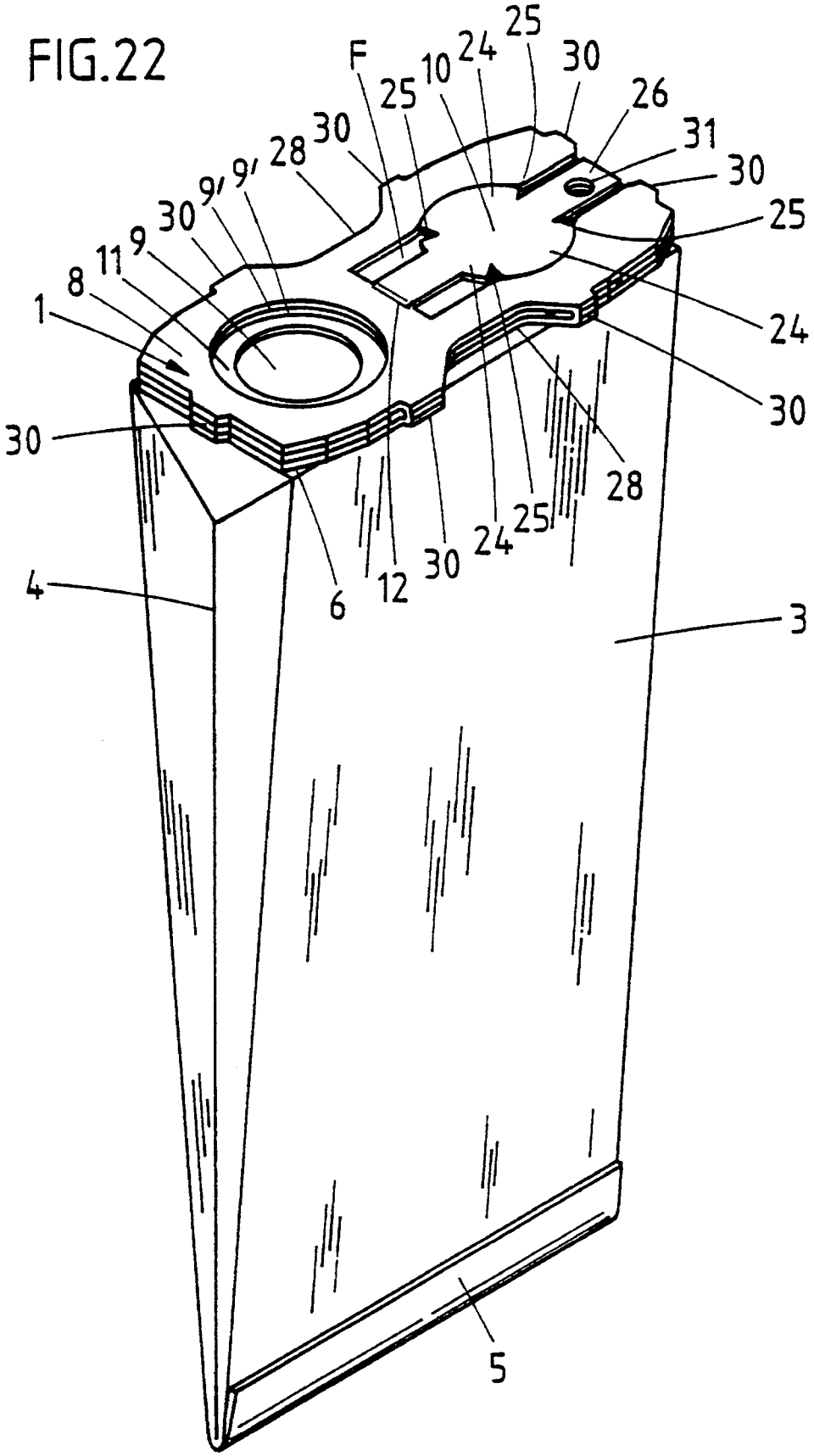
FIG. 22 is a perspective view of the dust filter bag, not closed.

The disposal position can be noted from FIG. 12. In that case, the holding handle 19 is swung into an upward-swung position. Thus, the dust filter bag can be conveniently removed from the vacuum cleaner housing and carried to the place of disposal. The closure tab 10 is previously,of course, brought into the closed position.

Figure 11:
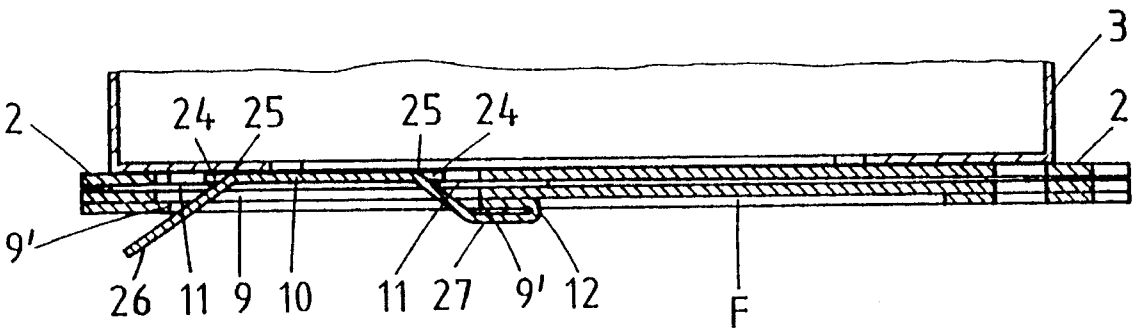
FIG. 11 is a section along the line XI—XI of FIG. 10.

The closure tab 10 in accordance with the second embodiment differs in construction from that of the embodiment first described insofar as its closure-active plate part now does not extend in closing fashion over the gasket 11 but engages in sealing manner by partial sections of its edge below the rubber gasket 11. This can be noted particularly clearly from FIGS. 10 and 11. The under-engaging edge sections of the closure tab 10, which in this case is circular, bear the reference numeral 24. On both ends, they are terminated by V-shaped incisions 25. The vertex thereof extends up to the inside diameter D1 of the rubber gasket 11, i.e. to the circular line. Adjoining the V-shaped incisions 25, a tongue 26 and a web 27 extend from the disk-shaped section of the closure tab 10. Both of them are directed radially and extend in the plane of symmetry, represented by the said section line. The web 27 leads to the hinge zone 12 of the closure tab 10 which is cut free in the inside of the U-shaped holding handle 9. The tongue 26, which is diametrically opposite the web 27, rests on the edge 9' of the opening of the uppermost layer a and prevents—in the same manner as the web 27—the closure tab extending in its inward pressed position into the inside of the bag 3. Rather, the radially extending extensions of the material effect a pressing force which acts resiliently against the bottom of the rubber gasket 11 and further a completely reliable seal.

In the third embodiment, the same properties and conditions are present, but with the structural difference that here the holding handle 19 is not cut free from the material of the remaining, i.e. opening-remote, region of the holding plate 1, but from the regions having the opening 9. This holding handle is also of U-shape and extends concentrically as well as radially outwardly spaced from the opening edge 9' of the opening 9. On the other side of this free cut material of the uppermost layer a remains, as a result of which the basic thickness x is retained also here up to the periphery.

In the remaining region of the holding plate 1, the closure tab 10 is again cut free.

Due to inwardly extending gripping niches 28 in the holding plate 1 which lie on the lengthwise sides the free ends of the U-arms 21 present there are shifted somewhat with respect to each other, as a result of which a sufficiently wide hinge-forming bridge of material remains also here in the uppermost layer a.

The said gripping niches can be included in the development of an association module, in the manner that in that case housing-side projections extend inward (not shown).

Otherwise, the holding plate has on its edge side several toothlike, inward directed projections 30 which enter into corresponding recesses in the housing and also serve to provide assurance that there has been no tampering. Such toothlike projections 30 are very stable, due to the threelayer character predominantly present.

As can be noted, in the embodiments having a holding handle 19, the hinge zone 23 does not extend in the transverse center plane of the holding plate but is rather offset somewhat in the direction towards the opening 9. In this way the larger accumulation of material of the holding plate 1 there is compensated for. On the other hand, however, in the carrying position, with the holding handle 19 being grasped, a slight lifting of this zone takes place so that, in any event, a pouring position of the dust filter bag is avoided, so that if the closure position has been missed no particles of dirt can drop out. The mouth is located higher up.

The fourth embodiment differs from the earlier ones insofar as in that case the part forming the tongue 26 is cut free in a zone which extends up to the edge of the holding plate 1, and therefore has a larger gripping length. Nevertheless, in this case also, the basic thickness x is substantially maintained, in the manner that the material of the top layer a is continued laterally up into the narrow side toothlike projections 30 present there. A fork-shaped section is present.

Furthermore, the V-shaped incisions 25 in the region of transition to the web 27 are no longer directly in the strip-shaped entrance zone between web 27 and disk-shaped section of the closure tab 10, but offset at an angle. In this way there is obtained a slight shortening of the edge sections 24 in the circumferential direction, which sections can thereby be more easily "threaded" into the opening 9 in order to come under the rubber gasket 11.

All embodiments have a hole 31 arranged in the other region of the holding plate and passing through all three layers. This hole extends close to the edge and lies in the plane of symmetry of the holding plate 1.

In this last embodiment, as well as in all embodiments following the solution first described, the reference numerals have been modified accordingly, without, for obvious reasons, repeating the text.

We claim:

1. A dust filter bag for a vacuum cleaner, having a holding plate comprising plural layers of a firm paper material including a first layer and a second layer and a third layer of the firm paper material, a dust filter bag element attached to the holding plate, the holding plate having a sealing-closable opening for a suction pipe of a vacuum cleaner, the filter bag further comprising a closure element for closing the opening upon displacement of the closure element from an open position alongside of the opening into a closed position;

wherein the closure element extends within said first layer of the firm paper material and lies on said second layer of the firm paper material, at least in an open position, and the holding plate further comprises a gasket of flexible material which is gripped between said second layer and said third layer of said plural layers in a region of the opening.

2. A dust filter bag according to claim 1, wherein the gasket is a rubber gasket, and within the holding plate, said first and said second and said third layers of paper material are arranged one above the other in the region of the opening.

3. A dust filter bag according to claim 1, wherein a free space is formed for a reception of the closure element between a first and a third of the layers in the region of the opening.

4. A dust filter bag according to claim 1, wherein the paper material is a cardboard paper material.

5. A dust filter bag according to claim 1, wherein the closure element is a closure tab.

6. A dust filter bag according to claim 1, wherein there is an opening edge region of a second of said layers which is set back with respect to corresponding opening edges of a first and a third of said layers.

7. A dust filter bag according to claim 1, wherein said second layer is located between said first and said third layers, each of said layers having an aperture at the opening for receiving the suction pipe, the second layer having a larger one of said apertures associated with the opening than the first and the third layers.

8. A dust filter bag according to claim 1, wherein the holding plate is developed continuously in at least three layers on an edge side.

9. A dust filter bag according to claim 1, wherein a portion of a top one of said layers constitutes a holding handle and that the holding handle is disposed about the opening.

10. A dust filter bag for a vacuum cleaner, having a holding plate comprising plural layers of a firm paper material, a filter bag element attached to the holding plate, the holding plate having a sealing-closable opening for a suction pipe of a vacuum cleaner, the filter bag further comprising a closure element for closing the opening upon displacement of the closure element from an open position alongside of the opening into a closed position;

wherein said holding plate further comprises a gasket encircling said opening, and there is a free space in the form of a detent opening which is formed between two of said layers in a region of the opening in order to receive and hold the closure element, said detent opening being covered on the bag side by a section of said gasket.

11. A dust filter bag for a vacuum cleaner, having a holding plate comprising plural layers of a firm paper material, a filter bag element attached to the holding plate, the holding plate having a sealing-closable opening for a suction pipe of a vacuum cleaner, the filter bag further comprising a closure element for closing the opening upon displacement of the closure element from an open position alongside of the opening into a closed position;

wherein said plural layers of paper material include a first layer and a second layer and a third layer, the first of said layers faces said filter bag element, and the second layer is disposed between the first layer and the third layer;

the holding plate further comprises a membrane disposed adjacent said second layer of paper material and extending past said opening, there being an aperture in said membrane concentric with said opening and smaller than said opening, said membrane with said aperture constituting a gasket for engagement with the suction pipe.

12. A dust filter bag according to claim 11, wherein said gasket is a rubber gasket.

13. A dust filter bag according to claim 11, wherein a first portion of said third layer, spaced apart from said opening, is bendable in a direction away from said second layer to form a closure element for closing the opening.

14. A dust filter bag according to claim 13, wherein a second portion of said third layer partially surrounds said closure element and is bendable in a direction away from said second layer to form a handle suitable for a carrying of the dust filter bag.

* * * * *